US005264995A

United States Patent [19]

McKee

[11] Patent Number: 5,264,995

[45] Date of Patent: Nov. 23, 1993

[54] NON-ELECTRIC CANDLE LAMP

[75] Inventor: Joan B. McKee, San Clemente, Calif.

[73] Assignee: Joan Baker Designs, Inc., San Clemente, Calif.

[21] Appl. No.: 950,086

[22] Filed: Sep. 22, 1992

[51] Int. Cl.[5] ..... F21L 19/00

[52] U.S. Cl. ..... 362/161; D26/11; 40/541

[58] Field of Search ..... 431/291; 362/161, 162, 362/163; D26/11; 40/541, 575

[56] References Cited

U.S. PATENT DOCUMENTS

| | | | |
|---|---|---|---|
| D. 095,999 | 6/1935 | Zeitlin | D26/11 |
| D. 317,052 | 5/1991 | Perkins | D26/11 |
| 1,660,760 | 2/1928 | Murphy | 40/541 |
| 4,017,729 | 4/1977 | Frazier | 362/161 |
| 4,926,298 | 5/1990 | Zimmerman | 362/163 |

FOREIGN PATENT DOCUMENTS

| | | | |
|---|---|---|---|
| 2220734 | 1/1990 | United Kingdom | 362/161 |

*Primary Examiner*—Carroll B. Dority
*Attorney, Agent, or Firm*—Stetina and Brunda

[57] ABSTRACT

A non-electric candle lamp generally comprising a base member defining an upper surface including a recess and an elongate slot formed therein. Releasably engaged to the upper surface of the base member is a diffuser member which defines front and back surfaces and a lower edge portion which is receivable into the slot. Received into the recess of the base member is a candle cup including a candle disposed therein. The slot is formed in the upper surface of the base member in a manner wherein the diffuser member is angled toward the candle cup when the lower edge portion is received into the slot.

8 Claims, 1 Drawing Sheet

NON-ELECTRIC CANDLE LAMP

FIELD OF THE INVENTION

The present invention relates generally to ornamental, decorative products, and more particularly to a non-electric, votive candle lamp.

BACKGROUND OF THE INVENTION

In the prior art, various types of ornamental lighting devices have been developed, many of which consist of a housing including written and/or decorative indicia thereon and a light source disposed within the housing. In certain devices, the light source consists of an electric lamp which serves to illuminate the surrounding housing when activated via a switch. In other devices, the light source consists of a candle.

In those ornamental devices wherein the light source consists of a candle, typically the outer housing is cylindrically or spherically configured and includes an open top through which the candle is inserted into the interior of the housing. In addition to facilitating the insertion of the candle into the housing, the open top is utilized to allow necessary oxygen to the candle flame.

In the aforementioned prior art ornamental lighting devices, and particularly those incorporating a candle as the light source, illuminated surfaces having a generally planar configuration are typically not presented. Rather, as previously specified, the housing of such devices generally only presents spherically or cylindrically configured surfaces which are illuminated. As will be recognized, the absence of planar surfaces oftentimes makes it difficult to read any written indicia or fully observe decorative indicia from a single vantage point. Additionally, in many such devices, the light source is easily observable through the top of the housing.

The present invention overcomes these deficiencies by providing a non-electric candle lamp which defines a generally planar illuminated viewing surface including written and/or decorative indicia thereon. The planar surface, when viewed from a proper vantage point, also serves to fully mask the light source.

SUMMARY OF THE INVENTION

In accordance with a preferred embodiment of the present invention, there is provided a non-electric candle lamp comprising a base member. Releasably engaged to the upper surface of the base member is a generally planar diffuser member which defines front and back surfaces. The candle lamp further includes a candle cup which is disposed on the upper surface of the base member and includes a candle releasably received therewithin. In the preferred embodiment, the upper surface of the base member includes a recess formed therein which is sized to receive a lower portion of the candle cup, and an elongate slot formed therein which is sized to receive a lower edge portion of the diffuser member. Advantageously, the slot is formed in the upper surface in a manner wherein the diffuser member is inclined toward the candle cup and candle when the lower edge portion is received therein.

In the preferred embodiment, the base member is fabricated from plastic, while the diffuser member is fabricated from glass. The front surface of the diffuser member preferably includes written and/or decorative indicia which is preferably painted thereon, while the back surface may be frosted. Additionally, both the candle cup and candle preferably have cylindrical configurations, with the candle cup being fabricated from glass which is itself frosted.

BRIEF DESCRIPTION OF THE DRAWINGS

These as well as other features of the present invention will become more apparent upon reference to the drawings wherein.

DETAILED DESCRIPTION OF THE PREFERRED EMBODIMENT

Figure 1:
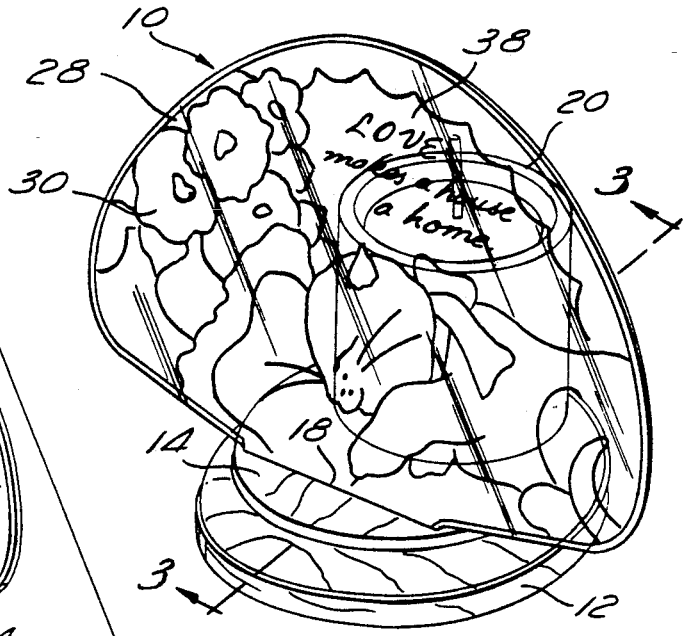
FIG. 1 is a front perspective view of a candle lamp constructed in accordance with the present invention.
Figure 2:
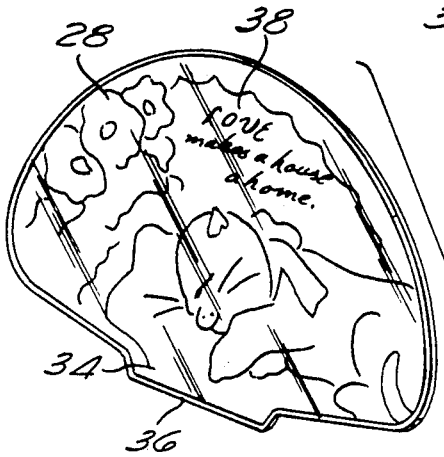
FIG. 2 is an exploded view of the components comprising the candle lamp shown in FIG. 1.
Figure 2:
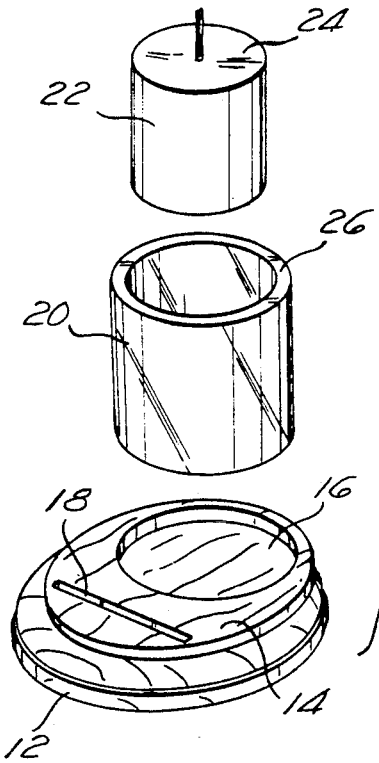
Figure 3:
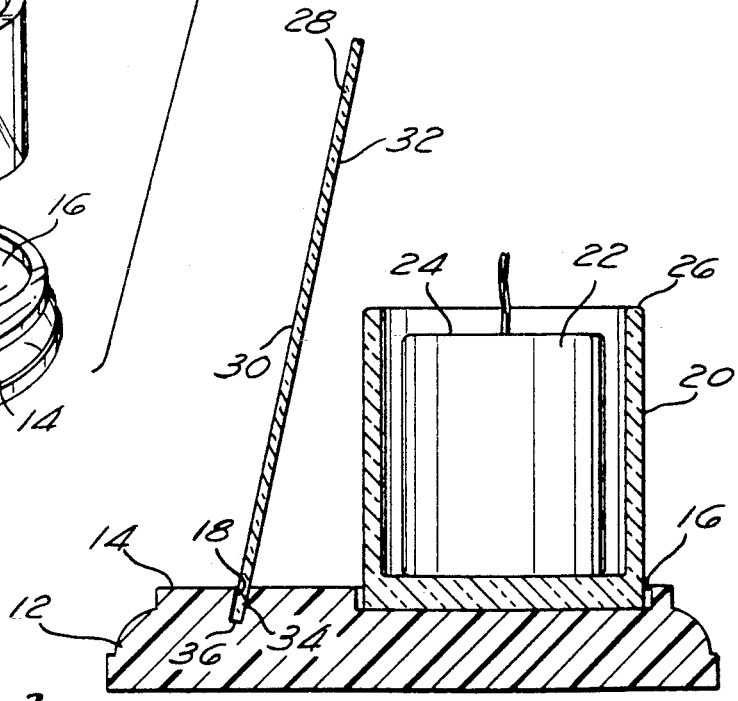
FIG. 3 is a cross-sectional view taken along line 3—3 of FIG. 1.

Referring now to the drawings wherein the showings are for purposes of illustrating a preferred embodiment of the present invention only, and not for purposes of limiting the same, FIG. 1 perspectively illustrates a non-electric, votive candle lamp 10 constructed in accordance with the preferred embodiment of the present invention. As best seen in FIGS. 2 and 3, candle lamp 10 generally comprises a base member 12 having an elliptical configuration and defining a generally planar upper surface 14. Formed in the upper surface 14 of base member 12 is a recess 16 having a generally circular configuration, and an elongate slot 18. As seen in FIG. 3, the slot 18 is preferably formed at an angle i.e. (inclined) within the base member 12 for reasons which will be discussed below.

The candle lamp 10 further comprises a candle cup 20 which has a generally cylindrical configuration. The candle cup 20 is interfaced to the base member 12 via the receipt of the closed lower end thereof into the recess 16. As seen in FIG. 3, the diameter of the recess 16 is sized to slightly exceed the outer diameter of the candle cup 20 to allow the same to be easily received thereinto. Releasably received into the candle cup 20 is a candle 22 which itself has a generally cylindrical configuration. As also seen in FIG. 3, the candle 22 is preferably sized having a diameter substantially less than the inner diameter of the candle cup 20 and a height wherein the top surface 24 of the candle 22 is disposed below the upper rim 26 of the candle cup 20 when disposed therewithin.

Releasably engaged to the upper surface 14 of the base member 12 is a diffuser member 28. In the preferred embodiment, diffuser member 28 has a generally planar configuration and defines a front surface 30 and a back surface 32. As shown in FIGS. 1 and 2, the diffuser member 28 is formed to include an extension 34 on the lower portion thereof which defines a lower edge 36. The diffuser member 28 is releasably engaged to the base member 12 via the receipt of the extension 34 into the slot 18 which has width slightly exceeding the thickness of the extension 34. The diffuser member 28 is preferably attached to the base member 12 in a manner wherein the back surface 32 faces the candle cup 20 and candle 22, with the lower edge 36 of the extension 34 being abutted against the bottom of the slot 18 when fully received therein.

As previously specified, the slot 18 is preferably formed in an angled orientation within the base member 12. Thus, as seen in FIG. 3, the receipt of the extension 34 into the angled slot 18 serves to angle the diffuser member 28 rearwardly toward the candle cup 20 and candle 22. As will be recognized, such angling of the diffuser member 28 facilitates easier viewing of the front surface 30 thereof. Additionally, the diffuser member 28 is preferably sized such that when engaged to the base member 12, the candle cup 20 and candle 22 are hidden thereby when the front surface 30 of the diffuser member 28 is viewed from the direction V. It will be recognized that the diffuser member 28 may be formed in various configurations other than that shown in FIGS. 1 and 2. In this respect, all that is necessary is that the diffuser member be formed to include the extension 34 on the lower portion thereof, and be sized to hide the candle cup 20 and candle 22 when engaged to the base member 12 and viewed from the direction V.

In the preferred embodiment, the diffuser member 28 is fabricated from glass, though other materials such as plastic may be utilized as an alternative. The front surface 30 of the diffuser member 28 includes written and/or decorative indicia 38 which is preferably hand-painted thereon. Additionally, the back surface 32 of the diffuser member 28 is preferably frosted to more fully diffuse the light passing therethrough, thus softening the appearance of the illuminated decorative indicia 38 on the front surface 30. Like the diffuser member 28, the candle cup 20 is also preferably fabricated from glass, and may itself be frosted to further soften the light emanating from the candle 22 therein. Additionally, the base member 12 is preferably fabricated from plastic, though other materials such as ceramics may also be used.

In the preferred embodiment of the present invention, the candle lamp 10 is utilized by initially placing the candle 22 within the candle cup 20 and lighting the same. Thereafter, the candle cup 20 is disposed within the recess 16 behind the diffuser member 28 in the manner previously described. As will be recognized, the candle 22 may be periodically replaced with new candles during prolonged use of the candle lamp 10. Additionally, differently configured or decorated diffuser members may be selectively engaged to the same base member 12.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. A non-electric candle lamp, comprising:

a base member defining an upper surface;

a diffuser member releasably engaged to the upper surface of said base member and defining front and back surfaces;

a candle cup disposed on the upper surface of said base member; and a candle releasably received into said candle cup;

the upper surface of said base member including a recess formed therein which is sized to receive a lower portion of said candle cup and an elongate slot formed therein which is sized to receive a lower edge portion of said diffuser member in a manner wherein said back surface of said diffuser member faces said candle.

2. The device of claim 1 wherein said front surface includes decorative indicia thereon.

3. The device of claim 2 wherein said diffuser member is fabricated from glass.

4. The device of claim 3 wherein the back surface is frosted.

5. The device of claim 1 wherein said candle cup is fabricated from glass.

6. The device of claim 5 wherein said candle cup is frosted.

7. The device of claim 1 wherein said slot is formed in the upper surface in a manner wherein said diffuser member is angled toward said candle cup when the lower edge portion is received therein.

8. The device of claim 7 wherein said base member is fabricated from plastic.

* * * * *